US011621486B2

(12) United States Patent
Daniel

(10) Patent No.: US 11,621,486 B2
(45) Date of Patent: Apr. 4, 2023

(54) METHOD AND APPARATUS FOR AN ACTIVE RADIATING AND FEED STRUCTURE

(71) Applicant: Metawave Corporation, Palo Alto, CA (US)

(72) Inventor: George Daniel, Palo Alto, CA (US)

(73) Assignee: METAWAVE Corporation, Carlsbad, CA (US)

( * ) Notice: Subject to any disclaimer, the term of this patent is extended or adjusted under 35 U.S.C. 154(b) by 0 days.

(21) Appl. No.: 16/130,872

(22) Filed: Sep. 13, 2018

(65) Prior Publication Data

US 2019/0081395 A1 Mar. 14, 2019

Related U.S. Application Data

(60) Provisional application No. 62/558,198, filed on Sep. 13, 2017.

(51) Int. Cl.
*H01Q 21/06* (2006.01)
*H01Q 1/52* (2006.01)
(Continued)

(52) U.S. Cl.
CPC ..... *H01Q 1/523* (2013.01); *H01Q 1/38* (2013.01); *H01Q 21/005* (2013.01); *H01Q 21/064* (2013.01); *H01Q 15/0086* (2013.01)

(58) Field of Classification Search
CPC ..... H01Q 21/0006; H01Q 21/0037; H01Q 21/0043; H01Q 21/005; H01Q 21/0062; H01Q 21/064
See application file for complete search history.

(56) References Cited

U.S. PATENT DOCUMENTS 7,250,908 B2 7/2007 Lee
7,847,739 B2 12/2010 Achour et al.
(Continued)

OTHER PUBLICATIONS

A. Ourir, et al., "Electromagnetically Induced Transparency in Symmetric Planar Metamaterial at THz Wavelengths," Photonics, vol. 2, pp. 308-316, Mar. 2015.
(Continued)

*Primary Examiner* — Daniel Munoz
(74) *Attorney, Agent, or Firm* — Sandra Lynn Godsey

(57) ABSTRACT

Examples disclosed herein relate to a radiating structure. The radiating structure has a transmission array structure having a plurality of transmission paths, with each transmission path having a plurality of slots. The radiating structure also has a radiating array structure of a plurality of radiating elements, with each radiating element corresponding to at least one slot from the plurality of slots, and at least one radiating element from the plurality of radiating elements comprising an integrated reactance control device. The radiating array structure is positioned proximate the transmission array structure. A feed coupling structure is coupled to the transmission array structure and adapted for propagation of a transmission signal to the transmission array structure, the transmission signal radiated through at least one of the plurality of slots and at least one of the plurality of radiating elements, the at least one reactance control device providing a phase shift in the radiated transmission signal.

20 Claims, 20 Drawing Sheets

(51) Int. Cl.

| | |
|---|---|
| ***H01Q 1/38*** | (2006.01) |
| ***H01Q 21/00*** | (2006.01) |
| *H01Q 15/00* | (2006.01) |

(56) References Cited

U.S. PATENT DOCUMENTS

| | | | | |
|---|---|---|---|---|
| 8,633,866 | B2 | 1/2014 | Sarabandi et al. | |
| 9,545,923 | B2 | 1/2017 | Casse et al. | |
| 2005/0035915 | A1* | 2/2005 | Livingston | H01Q 1/422 343/754 |
| 2009/0066597 | A1* | 3/2009 | Yang | H01Q 13/22 343/771 |
| 2015/0022421 | A1 | 1/2015 | Vigano et al. | |
| 2015/0318618 | A1* | 11/2015 | Chen | H01Q 21/005 343/750 |
| 2016/0013531 | A1* | 1/2016 | Casse | H01Q 3/36 333/161 |
| 2017/0331186 | A1* | 11/2017 | Linn | H01Q 3/36 |

OTHER PUBLICATIONS

C. Tripon-Canseliet, et al., "Contribution of MetaMaterials to Improvement of Scan Performance and Reconfigurability of Phased Array Antennas," International Radar Conference, Lille, France, pp. 1-3, Oct. 2014.

C.A. Allen, et al., "Leaky-Waves in a Metamaterial-Based Two-Dimensional Structure for a Conical Beam Antenna Application," IEEE MTT-S International Microwave Symposium Digest, Fort Worth, TX, pp. 305-308, Jun. 2004.

N. Zhou, et al. "Dislocation of Lattice Points for Impedance Matching of a Photonic Bandgap Cavity Resonator," 2019 USNC-URSI Radio Science Meeting (Joint with AP-S Symposium), Atlanta, GA, USA, pp. 37-38, 2019.

* cited by examiner

METHOD AND APPARATUS FOR AN ACTIVE RADIATING AND FEED STRUCTURE

CROSS-REFERENCE TO RELATED APPLICATIONS

This application claims priority to U.S. Provisional Application No. 62/558,198, filed on Sep. 13, 2017, and incorporated herein by reference.

BACKGROUND

As wireless systems and infrastructures are strained, and poised to reach limits, there is a need for systems and designs that meet these challenges. Similarly, from driver-assisted to autonomous vehicles, there is a need for advanced sensing and detection at millimeter wave frequencies and under challenging conditions. Developing devices that operate under these constraints and within these frequencies is challenging.

BRIEF DESCRIPTION OF THE DRAWINGS

The present application may be more fully appreciated in connection with the following detailed description taken in conjunction with the accompanying drawings, which are not drawn to scale, and in which like reference characters refer to like parts throughout, and in which.

DETAILED DESCRIPTION

Methods and apparatuses for an active radiating and feed structure are disclosed. The active radiating and feed structure is suitable for many different millimeter wave ("mm-wave") applications and can be deployed in a variety of different environments and configurations. Mm-wave applications are those operating with frequencies between 30 and 300 GHz or a portion thereof, including autonomous driving applications in the 77 GHz range and 5G applications in the 60 GHz range, among others. The active radiating and feed structure disclosed herein provides antennas with unprecedented capability of generating radio frequency ("RF") waves with improved directivity in both 5G and autonomous driving applications. Active components in the antennas are used to achieve smart beam steering and beam forming, reducing the antennas' complexity and processing time and enabling fast scans of up to approximately a 360° Field-of-View ("FoV") for long range target detection.

It is appreciated that, in the following description, numerous specific details are set forth to provide a thorough understanding of the examples. However, it is appreciated that the examples may be practiced without limitation to these specific details. In other instances, well-known methods and structures may not be described in detail to avoid unnecessarily obscuring the description of the examples. Also, the examples may be used in combination with each other.

Figure 1:
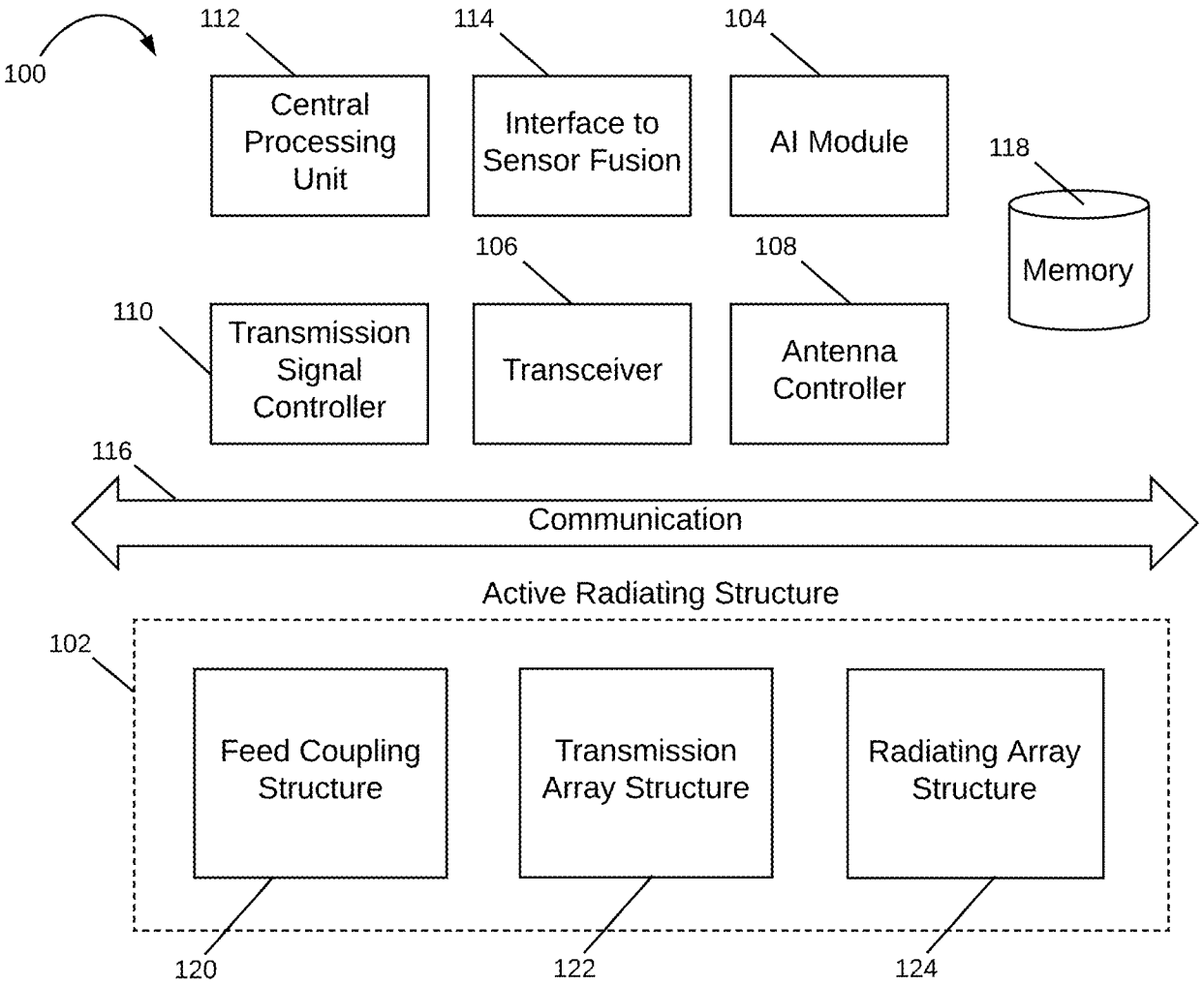
FIG. 1 illustrates a system having a radiating structure or device in accordance with various examples.

FIG. 1 illustrates a system having a radiating structure or device in accordance with various examples. System 100 is a "digital eye" with true 3D vision and capable of a human-like interpretation of the world. The "digital eye" and human-like interpretation capabilities are provided by two main modules: radiating structure 102 and AI module 104.

Radiating structure 102 is capable of radiating dynamically controllable and highly-directive RF beams. Radiating structure 102 has a feed coupling structure 120, a transmission array structure 122, and a radiating array structure 124. When a transmission signal is provided to the radiating structure 102, such as through circuitry, a coaxial cable, a wave guide, or other type signal feed connector, the signal propagates through the feed coupling structure 120 to the transmission array structure 122 and then to radiating array structure 124 for transmission through the air as a radio frequency ("RF") beam. A variety of signals may be provided to the radiating structure 102 for transmission, such as from a transmission signal controller 110 through a transceiver 106.

In an example application, the radiating structure 102 can be implemented in a radar sensor for use in a driver-assisted or autonomous vehicle. The transmission signal may be a Frequency Modulated Continuous Wave ("FMCW") signal, which is used for radar sensor applications as the transmitted signal is modulated in frequency, or phase. The FMCW signal enables a radar to measure range to a target by measuring timing and phase differences in phase or frequency between the transmitted signal and the received or reflected signal. Within FMCW formats, there are a variety of modulation patterns that may be used within FMCW, including triangular, sawtooth, rectangular and so forth, each having advantages, challenges, and application for various purposes. For example, sawtooth modulation may be selected for use when detection involves large distances to a target, i.e., long range. In some examples, the shape of the wave form provides speed and velocity information based on the Doppler shift between signals. This information enables construction of a range-Doppler map to indicate a location and movement of a detected object. As used herein, a target is any object detected by the radar, but may also refer to a specific type of object, e.g., a vehicle, a person, a road sign, and so on.

In another example application, the radiating structure 102 is applicable in a wireless communication or cellular system, implementing user tracking from a base station, fixed wireless location, and so on, or function as a wireless relay to provide expanded coverage to users in a wireless network. The transmission signal in cellular communications is a coded signal, such as a cellular modulated Orthogonal Frequency Division Multiplexed ("OFDM") signal. Other types of signals may also be used with radiating structure 102, depending on the desired application.

Transceiver module 106 coupled to the radiating structure 102 prepares a signal for transmission, wherein the signal is defined by modulation and frequency. The signal is provided to the radiating structure 102 through a coaxial cable or other connector and propagates through the radiating structure 102 for transmission through the air via RF beams at a given phase and direction. The RF beams and their parameters (e.g., beam width, phase, azimuth and elevation angles, etc.) are controlled by antenna controller 108, such as at the direction of AI module 104.

The RF beams reflect off of targets and the RF reflections are received by the transceiver module 106. Radar data from the received RF beams is provided to the AI module 104 for target detection and identification. The radar data may be organized in sets of Range-Doppler ("RD") map information, corresponding to 4D information that is determined by each RF beam radiated off of targets, such as azimuthal angles, elevation angles, range, and velocity. The RD maps may be extracted from FMCW radar pulses and contain both noise and systematic artifacts from Fourier analysis of the pulses. The AI module 104 may control further operation of the radiating structure 102 by, for example, providing beam parameters for the next RF beams to be radiated from the radiating structure 102.

In operation, the antenna controller 108 is responsible for directing the radiating structure 102 to generate RF beams with determined parameters such as beam width, transmit angle, and so on. The antenna controller 108 may, for example, determine the parameters at the direction of the AI module 104, which may at any given time want to focus on a specific area of an FoV upon identifying targets of interest in a vehicle's path or surrounding environment. The antenna controller 108 determines the direction, power, and other parameters of the beams and controls the radiating structure 102 to achieve beam steering in various directions. The antenna controller 108 also determines a voltage matrix to apply to reactance control mechanisms or devices in radiating structure 102 to achieve a given phase shift. In various examples, the radiating structure 102 is adapted to transmit a directional beam through active control of the reactance parameters of individual radiating elements in radiating array structure 124. The radiating structure 102 radiates RF beams having the determined parameters. The RF beams are reflected off of targets (e.g., in a 360° FoV) and are received by the transceiver module 106.

In various examples described herein, the use of system 100 in an autonomous driving vehicle provides a reliable way to detect targets in difficult weather conditions. For example, historically a driver will slow down dramatically in thick fog, as the driving speed decreases with decreases in visibility. On a highway in Europe, for example, where the speed limit is 115 km/h, a driver may need to slow down to 40 km/h when visibility is poor. Using the radar system 100, the driver (or driverless vehicle) may maintain the maximum safe speed without regard to the weather conditions. Even if other drivers slow down, a vehicle enabled with the system 100 will be able to detect those slow-moving vehicles and obstacles in the way and avoid/navigate around them.

Additionally, in highly congested areas, it is necessary for an autonomous vehicle to detect objects in sufficient time to react and take action. The examples provided herein for system 100 increase the sweep time of a radar signal so as to detect any echoes in time to react. In rural areas and other areas with few obstacles during travel, the system 100 adjusts the focus of the beam to a larger beam width, thereby enabling a faster scan of areas where there are few echoes. The AI module 104 may detect this situation by evaluating the number of echoes received within a given time period and making beam size adjustments accordingly. Once a target is detected, the AI module 104 determines how to adjust the beam focus. This is achieved by changing the specific configurations and conditions of the radiating structure 102.

All of these detection scenarios, analysis and reactions may be stored in the AI module 104 and used for later analysis or simplified reactions. For example, if there is an increase in the echoes received at a given time of day or on a specific highway, that information is fed into the antenna controller 108 to assist in proactive preparation and configuration of the radiating structure 102.

In operation, the antenna controller 108 receives information from AI module 104 or other modules in system 100 indicating a next radiation beam, wherein a radiation beam may be specified by parameters such as beam width, transmit angle, transmit direction and so forth. The antenna controller 108 determines a voltage matrix to apply to reactance control mechanisms or devices in radiating structure 102 to achieve a given phase shift or other parameters. In these examples, the radiating structure 102 is adapted to transmit a directional beam without using digital beam forming methods, but rather through active control of the reactance parameters of the individual radiating elements that make up radiating array structure 124. In one example scenario, the voltages on the reactance control devices in radiating array structure 124 are adjusted. In other examples, the individual radiating elements may be configured into subarrays that have specific characteristics. This configuration means that this subarray may be treated as a single unit, and all the reactance control devices are adjusted similarly. In another scenario, the subarray is changed to include a different number of radiating elements, where the combination of radiating elements in a subarray may be changed dynamically to adjust to conditions and operation of the system 100.

Figure 2:
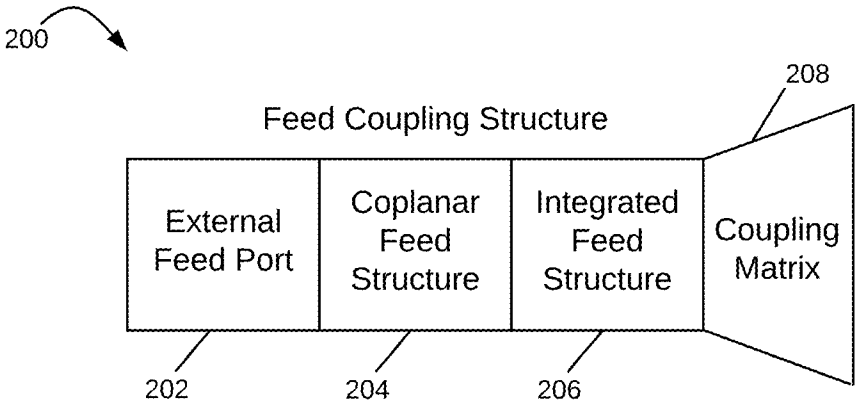
FIG. 2 is a schematic diagram of an example feed coupling structure for use in a radiating structure as in FIG. 1.

Each of the structures 120-124 in radiating structure 102 is now described in more detail. FIG. 2 is a schematic diagram of an example feed coupling structure for use in the radiating structure of FIG. 1. The feed coupling structure 102 in some examples acts to divide received power along a network of transmission lines. The power division may be to support propagation of a received signal for transmission to the radiating array structure 124 of FIG. 1, such as for transmitting signals over the air, where the radiating array structure 124 acts as a transmit antenna. The power division may also be to support propagation of energy received at the radiating array structure 124 to other parts of the system 100, where the radiating array structure 124 acts as a receive antenna.

Feed coupling structure 200 includes an external feed port 202 adapted to receive a transmission signal such as by way of a coaxial cable or other signal source. The external feed port 202 interfaces with coplanar feed structure 204 for propagation of the received transmission signal. The coplanar feed structure 204 then interfaces with the integrated feed structure 206, which is integrated within a substrate, wherein the received transmission signal propagates through the substrate to the coupling matrix 208. The integrated feed structure 206 includes transmission paths along the substrate through which the transmission signal propagates and may include vias through the substrate to form wave guide structures in order to maintain the transmission signal within the transmission paths of the integrated feed structure 206. Such vias prevent the transmission signal from significantly propagating out of the integrated feed structure 206. The coupling matrix 208 couples the integrated feed structure 206 with the transmission array structure 122 of FIG. 1. The coupling matrix 208 is configured to distribute a received transmission signal to a plurality of transmission paths of the transmission array structure 122 of FIG. 1. The coupling matrix 208 divides the energy of the transmission signal, such that each of the transmission paths receives a substantially equal portion of the signal. In some examples, this distribution may not be equally divided, such as to taper the transmissions at certain points of the transmission array structure 122 of FIG. 1.

Figure 3:
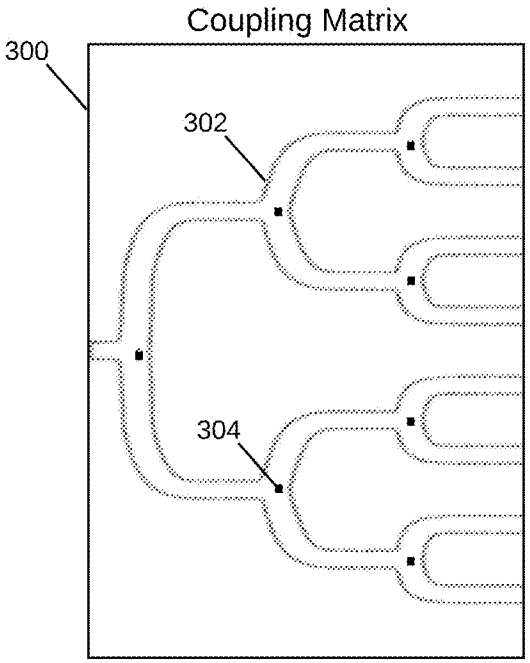
FIG. 3 illustrates an example coupling matrix for use in a feed coupling structure as in FIG. 2.

An example coupling matrix 208 for use in the feed coupling structure 200 is illustrated in FIG. 3. The coupling matrix 300 is a type of a power divider circuit such that it takes an input signal and divides it through a network of coupling paths or transmission lines 302 that are formed from vias in the substrate. These vias extend through a second conductive layer in the substrate and are lined, or plated, with conductive material. The coupling paths 302 act to distribute the received transmission signal to the transmission array structure 122 of FIG. 1. Each coupling path may have similar dimensions; however, the size of the paths may be configured to achieve a desired transmission and/or radiation result. In various examples, the coupling matrix 300 is designed to be impedance-matched, such that the impedances at each end of a transmission line/coupling patch matches the characteristic impedance of the line. Matching vias such as matching via 304 are incorporated in the coupling paths to improve impedance matching. In the illustrated example, there are eight (8) coupling paths, corresponding to 8 transmission array elements. Alternate examples may use traditional or other waveguide structures or transmission signal guide structures.

Figure 4:
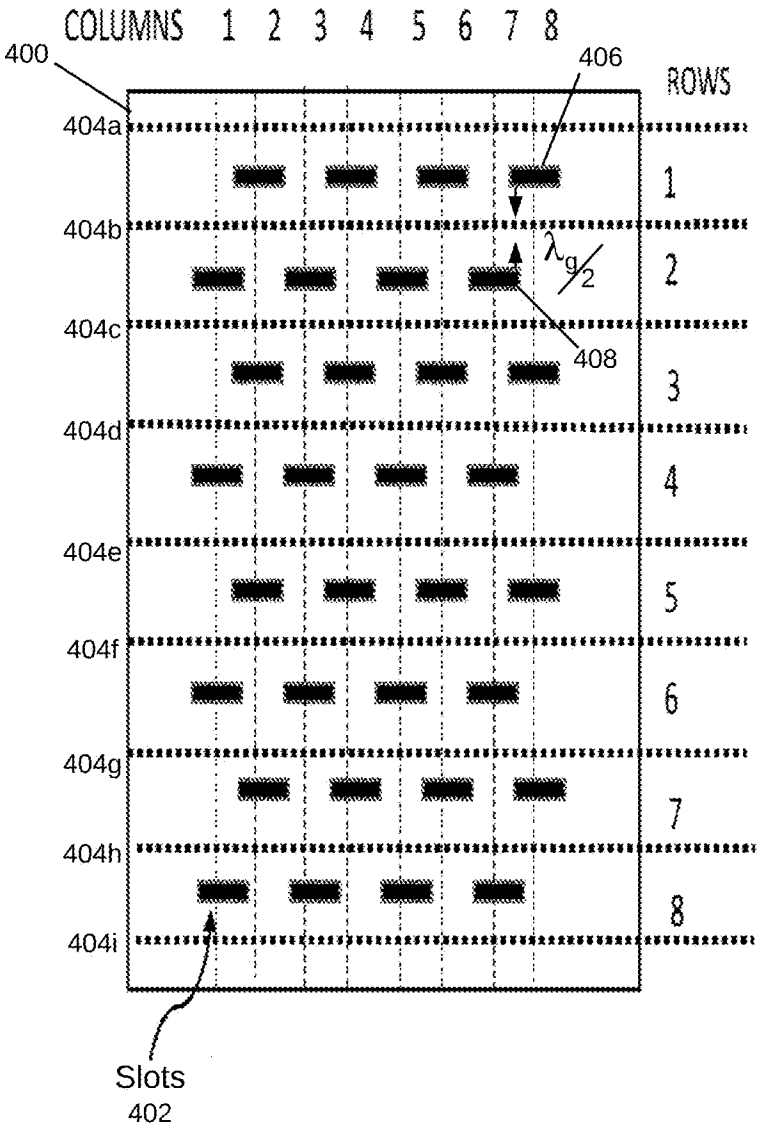
FIG. 4 is a schematic diagram of an example transmission array structure for use in a radiating structure as in FIG. 1.

Referring now to FIG. 4, a schematic diagram of an example transmission array structure for use in the radiating structure of FIG. 1 is described. The transmission array structure 400 is made up of an array of transmission paths bounded by a set of vias that maintain the transmission signal therein. The vias are configured as holes that pass through the substrate to a conductive layer or reference layer (not shown). The vias are lined with a conductive material.

The transmission array structure 400, as illustrated in FIG. 4, is defined by a number of rows, r, and a number of columns, c. The rows correspond to each of the transmission paths. For the reader's comprehension, a graph is superimposed over the transmission array 400 to provide the approximate position of each element. Each of the eight (8) rows of the transmission array structure 400 has a corresponding row in the radiating array structure 124 of FIG. 1. In the illustrated example, the horizontal lines represent the vias 404 formed in the substrate to create paths for the transmission signal in each row. The vias are spaced so as to maintain the transmission signal within the path of each row. As illustrated, via lines 404*a* and 404*b* bound the transmission signal within row 1.

Each row of the transmission array 400 has multiple discontinuities, slots or openings 402, formed into the substrate, through which the propagated signal will radiate. As illustrated, there are multiple slots 402, such as the four (4) slots illustrated per row. In this illustration, there are 4 slots per row the slots of adjacent rows are offset from one another by one column length. In this configuration, the slots 402 correspond positionally to the radiating elements of the radiating array structure 124 of FIG. 1 and described in more detail below.

The propagating signal radiates through a slot 402 to a proximate radiating element, from which the signal is transmitted through the environment. The slots in the transmission array structure 400 are formed lengthwise throughout each row. Each row can be thought of as a waveguide. The effective waveguide structure is bounded by conductive vias along its length and grounded at its end. The dimensions are designed such that the waveguide end is an equivalent open circuit, avoiding signal reflections. The distance between the center of a slot in a row of transmission array structure 400 and the center of an adjacent equidistant slot is shown as $\lambda_g/2$, where $\lambda_g$ is the guide wavelength.

Figure 5:
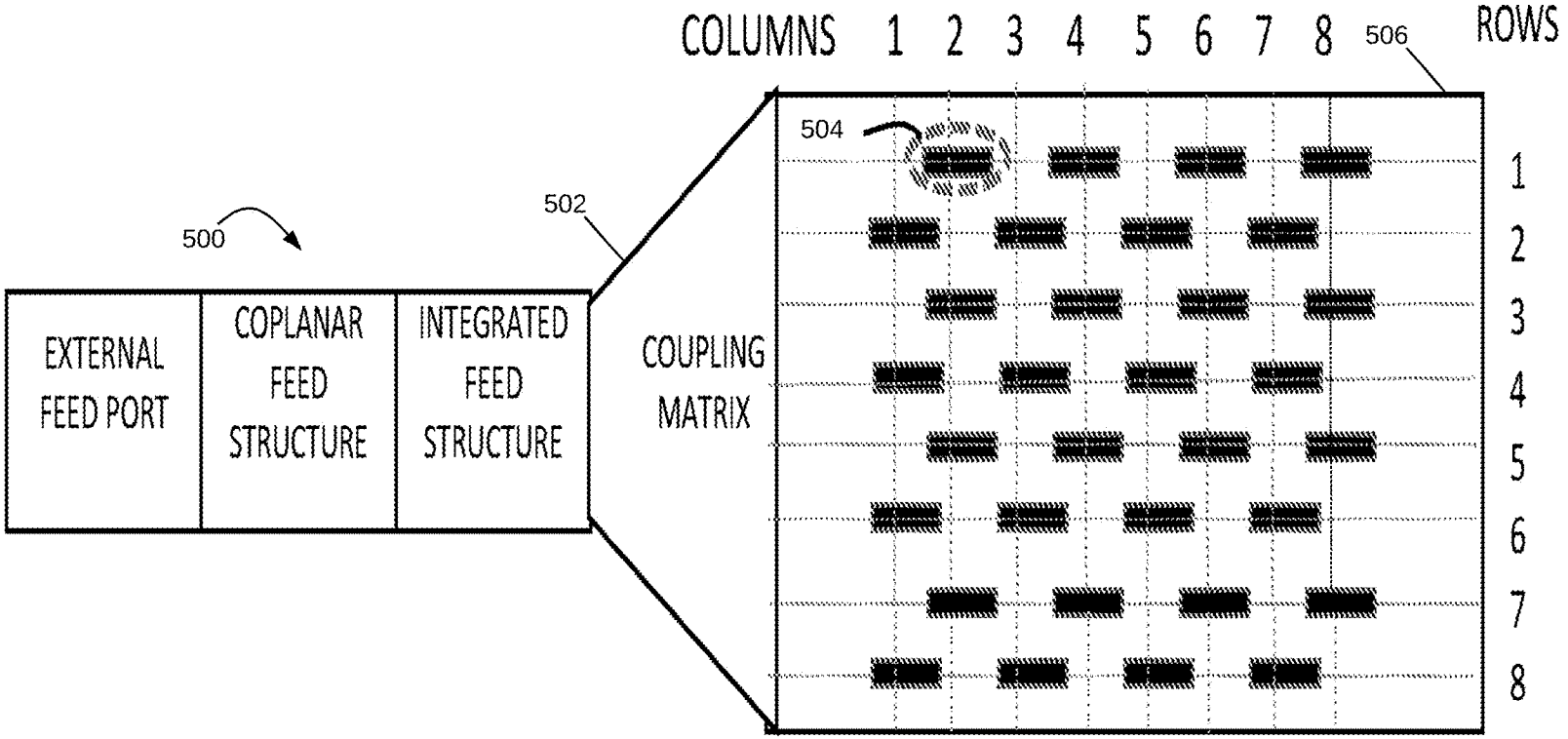
FIG. 5 illustrates a feed coupling structure as in FIG. 2 coupled to a transmission array structure as in FIG. 4 in accordance with various examples.

In another example, transmission array structure 506 is connected to a feed coupling structure as shown in FIG. 5. Feed coupling structure 500 has coupling matrix 502, which can be implemented as the example coupling matrix 300 of FIG. 3 with eight (8) coupling paths, with each coupling path providing a signal to a corresponding row of the transmission array 506. The signal radiates through the slots in the rows, e.g., slot 504, to a corresponding radiating element of a radiating array structure, e.g., radiating array structure 124 of FIG. 1.

Figure 6:
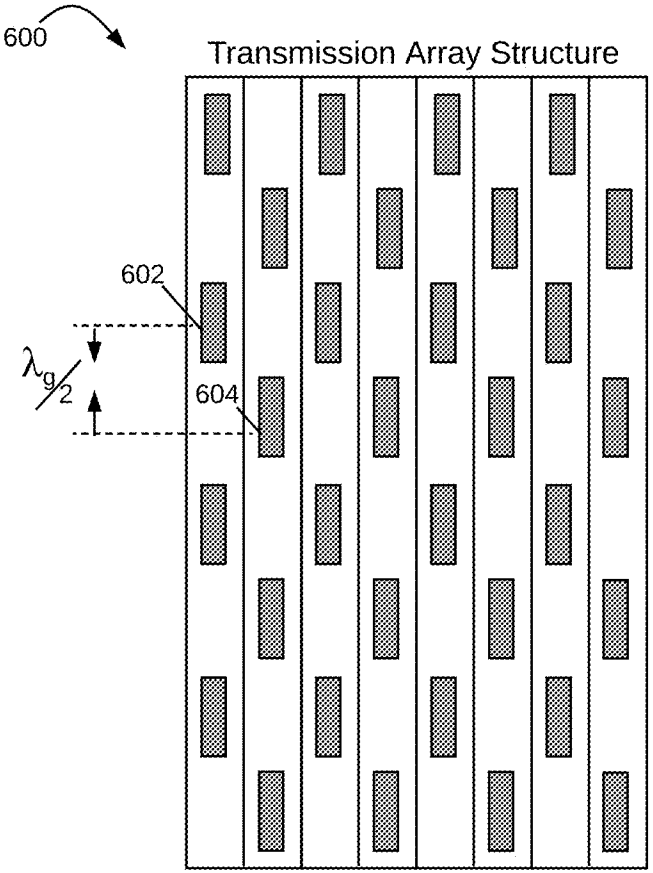
FIGS. 6-8 illustrates other examples of a transmission array structure for use in a radiating structure as in FIG. 1.

Another example transmission array structure is illustrated in FIG. 6. Transmission array structure 600 has a perpendicular orientation with respect to transmission array structure 400 of FIG. 4, wherein slots are positioned along columns rather than rows. In this illustrated example, a feed coupling structure would also have a vertical orientation, with coupling paths or transmission lines of its coupling matrix supporting the propagation of transmitting signals to the columns rather than the rows of transmission array structure 600. In this example, the center of adjacent slots of transmission array structure 600, e.g., slots 602-604, are distanced by $\lambda_g/2$, where $\lambda_g$ is the guide wavelength of a waveguide along a column of transmission array structure 600.

Figure 7:
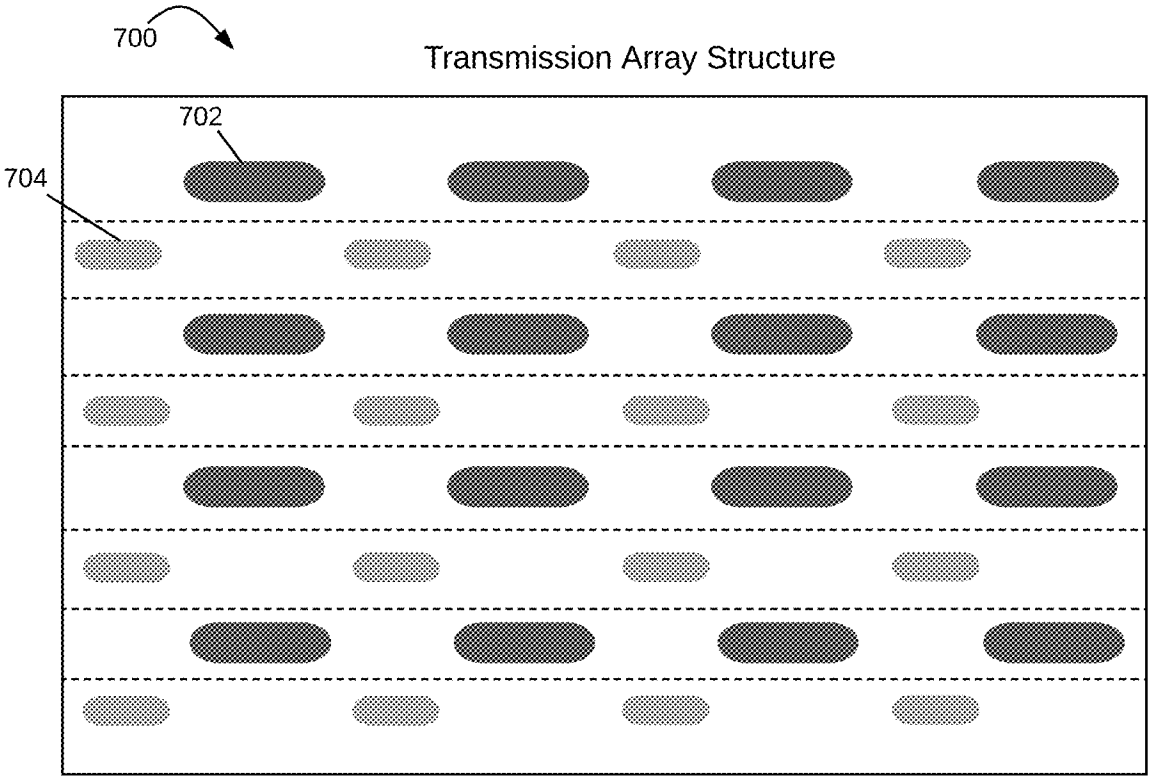
Figure 8:
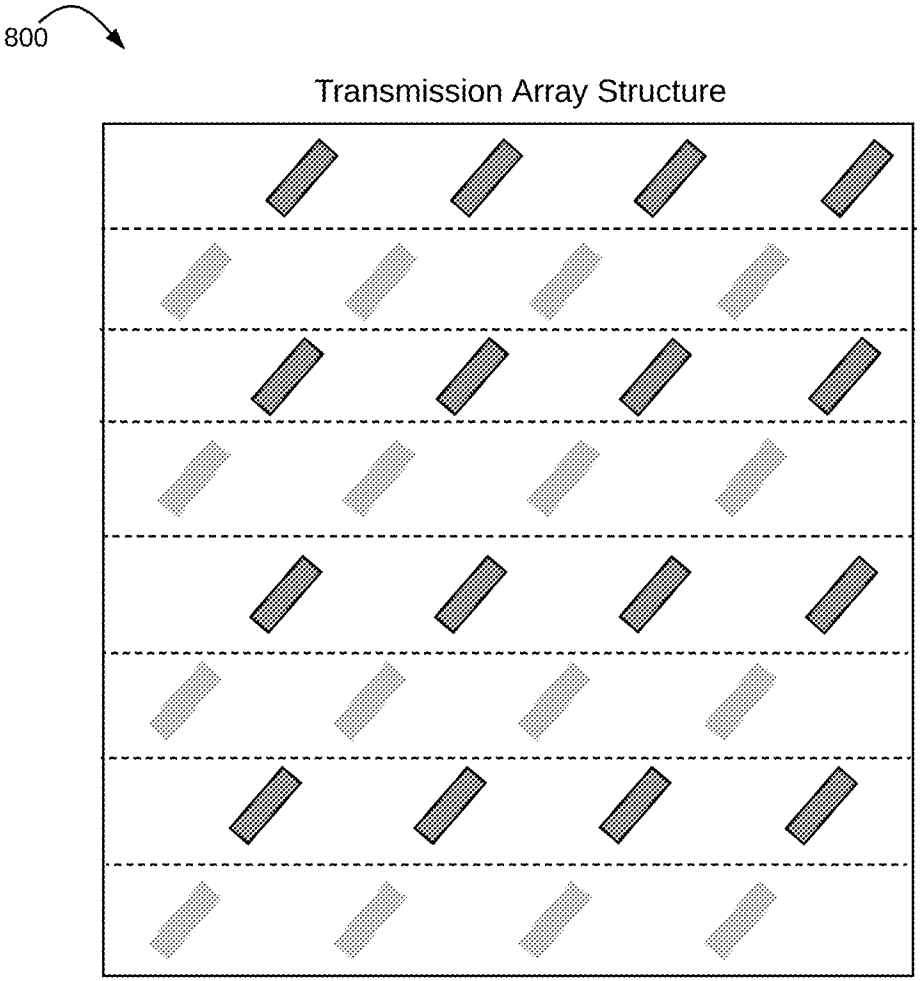

It is appreciated that the slots in transmission array structures 400 and 600 are shown to have a rectangular shape for illustration purposes only. Slots may be designed to have different shapes, orientations and be of different sizes, depending on the desired application. There could also different variations in the number of slots. A transmission array structure may be a 4×4 array, an 8×8 array, a 16×16 array, a 32×32 array, a 4×8 array, a 4×16 array, an 8×32 array, and so on. An example of such a transmission array is shown in FIG. 7, where the transmission array structure 700 has 8 rows and 4 columns and is therefore an 8×4 array. As illustrated, the slots in transmission array structure 700 have an oval shape and different sizes, with slots in a row having one size, e.g., slot 702, and the slots in an adjacent row, e.g., slot 704, having another size. Slots may be smaller at the edges of the transmission array structure 700 to taper a transmission signal. Further, slots may also be oriented at an angle with respect to a row of a transmission array structure, as shown in FIG. 8, with transmission array structure 800. The position, shapes, configuration and so forth are destined to achieve a desired result. These form the radiation patterns transmitted and received and affect the gain, side lobes and other characteristics of EM signals.

Figure 9:
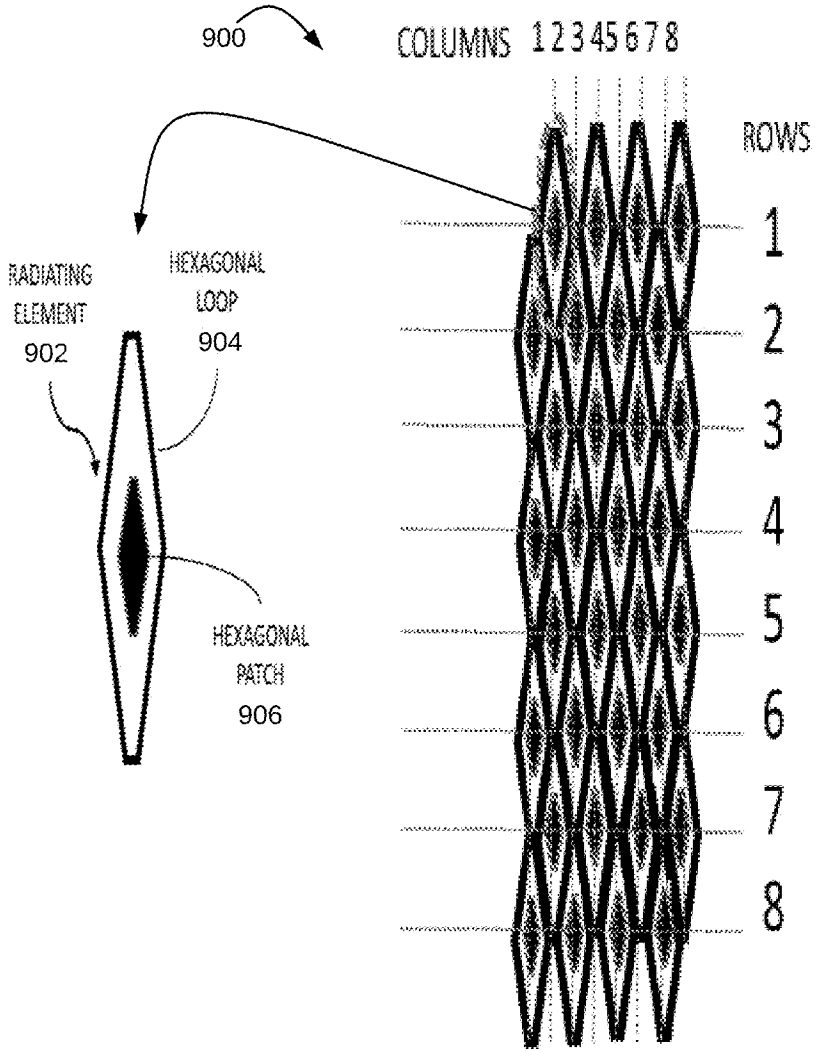
FIG. 9 is a schematic diagram of a radiating array structure for use in a radiating structure as in FIG. 1 in accordance with various examples.
Figure 9:
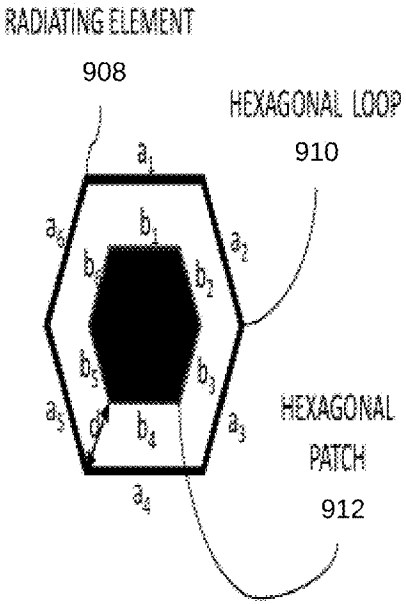

Attention is now directed to FIG. 9, which shows a radiating array structure for use in the radiating structure of FIG. 1 in accordance with various examples. Radiating array structure 900 includes multiple individual elements, e.g., radiating element 902, to form a lattice structure of hexagonal elements. The radiating array structure 900 is designed to operate in coordination with the transmission array structure 122 of FIG. 1, wherein individual radiating elements correspond to individual slots within the transmission array structure 122. Each hexagonal element is designed to radiate at the transmission signal frequency, wherein each hexagonal element is of the same shape and size. Each slot in a transmission array structure and corresponding radiating element in a radiating array structure have a fixed relationship, wherein the center of each slot corresponds to the center of the radiating patch of a radiating element. In this way, the radiating structure 900 provides a wireless signal, such as a radar signal.

As illustrated, the radiating elements' hexagonal shape provides design flexibility for a densely packed array. Each radiating element has an outer geometric shape, referred to herein as a hexagonal conductive loop, e.g., loop 904, and an inner geometric shape that is referred to as a hexagonal conductive patch, e.g., patch 906. The hexagonal shape provides the flexibility of design for a densely packed array, and the parametric shape enables computational design that can be easily scaled and modified while maintaining the basic shape of the hexagon. The outer geometric shape is referred to herein as a hexagonal loop 904 and 910; and the circumscribed inner geometric shape is referred to as a hexagonal patch 906 and 912. In this example, the dimensions of the shapes are geometrically similar and their relationship is proportionally maintained.

Figure 10:
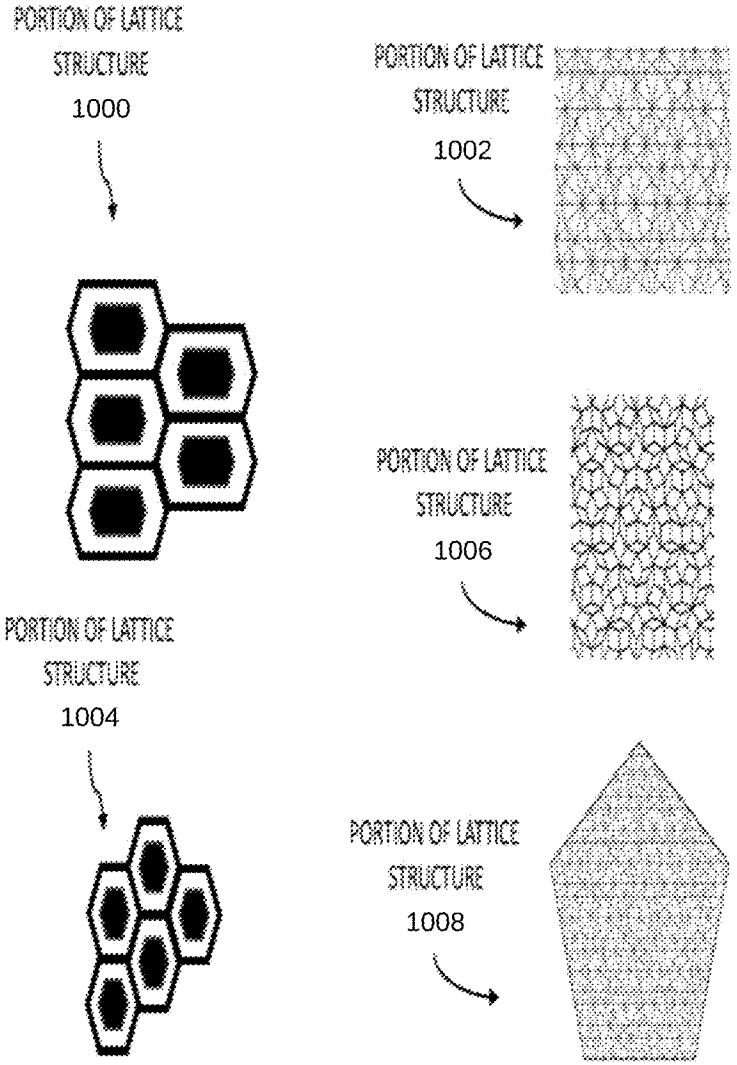
FIG. 10 illustrates examples of scaling of various hexagonal radiating elements, and their positioning within lattices.

As illustrated, the sides of the hexagonal loop 910 are designated by reference letter "a" and the sides of the hexagonal patch 912 are designated by reference letter "b". The hexagonal patch 912 is centered within the hexagonal loop 910. Corresponding points on the perimeters of the loop and patch are equidistant from each other, specifically in this example, at a distance designated by "d". This configuration is repeated to form a densely packed lattice. FIG. 10 illustrates examples of scaling of various hexagonal radiating elements, and their positioning within lattices 1000-1008. There is a large variety of hexagonal shapes and configurations that may be implemented, both symmetric and asymmetric. Note also that although illustrated as having a hexagonal shape, a radiating element may be of another shape, e.g., circular, rectangular, etc., depending on the application. A variety of sizes, configurations and designs may be implemented.

In various examples, a radiating element is a metamaterial element. A metamaterial is an artificially structured element used to control and manipulate physical phenomena, such as the electromagnetic ("EM") properties of a signal including its amplitude, phase, and wavelength. Metamaterial structures behave as derived from inherent properties of their constituent materials, as well as from the geometrical arrangement of these materials with size and spacing that are much smaller relative to the scale of spatial variation of typical applications. A metamaterial is not a tangible new material, but rather is a geometric design of known materials, such as conductors, that behave in a specific way. A metamaterial element may be composed of multiple microstrips, gaps, patches, vias, and so forth, having a behavior that is the equivalent to a reactance element, such as a combination of series capacitors and shunt inductors. Various configurations, shapes, designs and dimensions may be used to implement specific designs and meet specific constraints. In some examples, the number of dimensional degrees of freedom determines the device characteristics, wherein a device having a number of edges and discontinuities may model a specific-type of electrical circuit and behave in a similar manner. In this way, a radiating element radiates according to its configuration. Changes to the design parameters of a radiating element result in changes to its radiation pattern. Where the radiation pattern is changed to achieve a phase change or phase shift, the resultant structure is a powerful antenna or radar, as small changes to the radiating element can result in large changes to the beamform.

In various examples, a metamaterial radiating element has some unique properties. These properties may include a negative permittivity and permeability resulting in a negative refractive index; these structures are commonly referred to as left-handed materials ("LHM"). The use of LHM enables behavior not achieved in classical structures and materials, including interesting effects that may be observed in the propagation of electromagnetic waves, or transmission signals. Metamaterials can be used for several interesting devices in microwave and terahertz engineering such as antennas, sensors, matching networks, and reflectors, such as in telecommunications, automotive and vehicular, robotic, biomedical, satellite and other applications. For antennas, metamaterials may be built at scales much smaller than the wavelengths of transmission signals radiated by the metamaterial. Metamaterial properties come from the engineered and designed structures rather than from the base material forming the structures. Precise shape, dimensions, geometry, size, orientation, arrangement and so forth result in the smart properties capable of manipulating EM waves by blocking, absorbing, enhancing, or bending waves.

Figure 11:
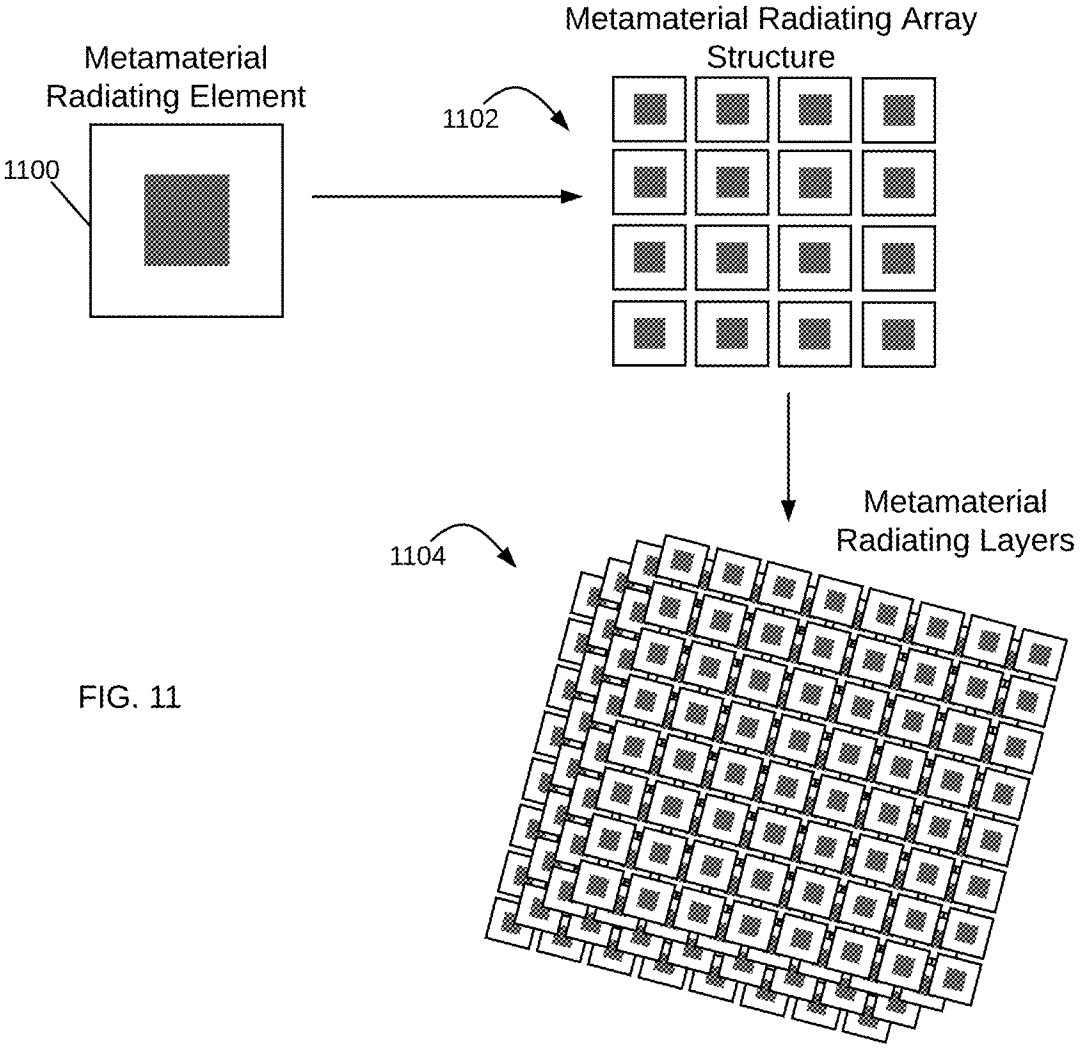
FIG. 11 is a schematic diagram of a metamaterial radiating element, a single layer radiating array structure and a multi-layer radiating array structure in accordance with various examples.

In FIG. 11, a metamaterial radiating element 1100 is shown to have a rectangular shape. The metamaterial radiating element 1100 can be arranged in a radiating array structure 1102 much like the radiating array structure 900 in FIG. 9 and the radiating array structure 106 in FIG. 1. Note that in structure 1102, the radiating elements are spaced apart by a distance that is determined based on the desired radiation pattern and beam characteristics. Note also that a radiating array structure may be implemented as a layer in a multi-layer radiating array, such as metamaterial radiating layers 1104 having 4 layers of 8×8 radiating arrays. The number of elements in an array, the shape of the elements, the spacing between the elements, and the number of layers can all be designed to match the parameters of a corresponding transmission array structure and achieve a desired radiation pattern and performance in a radiating structure.

In some examples, the lattice structure of a radiating array structure is formed by an array of individual radiating elements having dimensions that allow control of the phase of a radiating transmission by changing an effective reactance of the element through application of a voltage to a varactor. The radiating element may take any of a variety of shapes and configurations and be formed as conductive traces on a substrate including a dielectric layer. The varactor control may be thought of as a reactance control array, wherein each of the varactors is controlled by an individual reverse bias voltage resulting in an effective capacitance change to at least one individual radiating element. The varactor then controls the phase of the transmission of each radiating element, and together the entire radiating array structure transmits am electromagnetic radiation beam having a desired phase.

Figure 12:
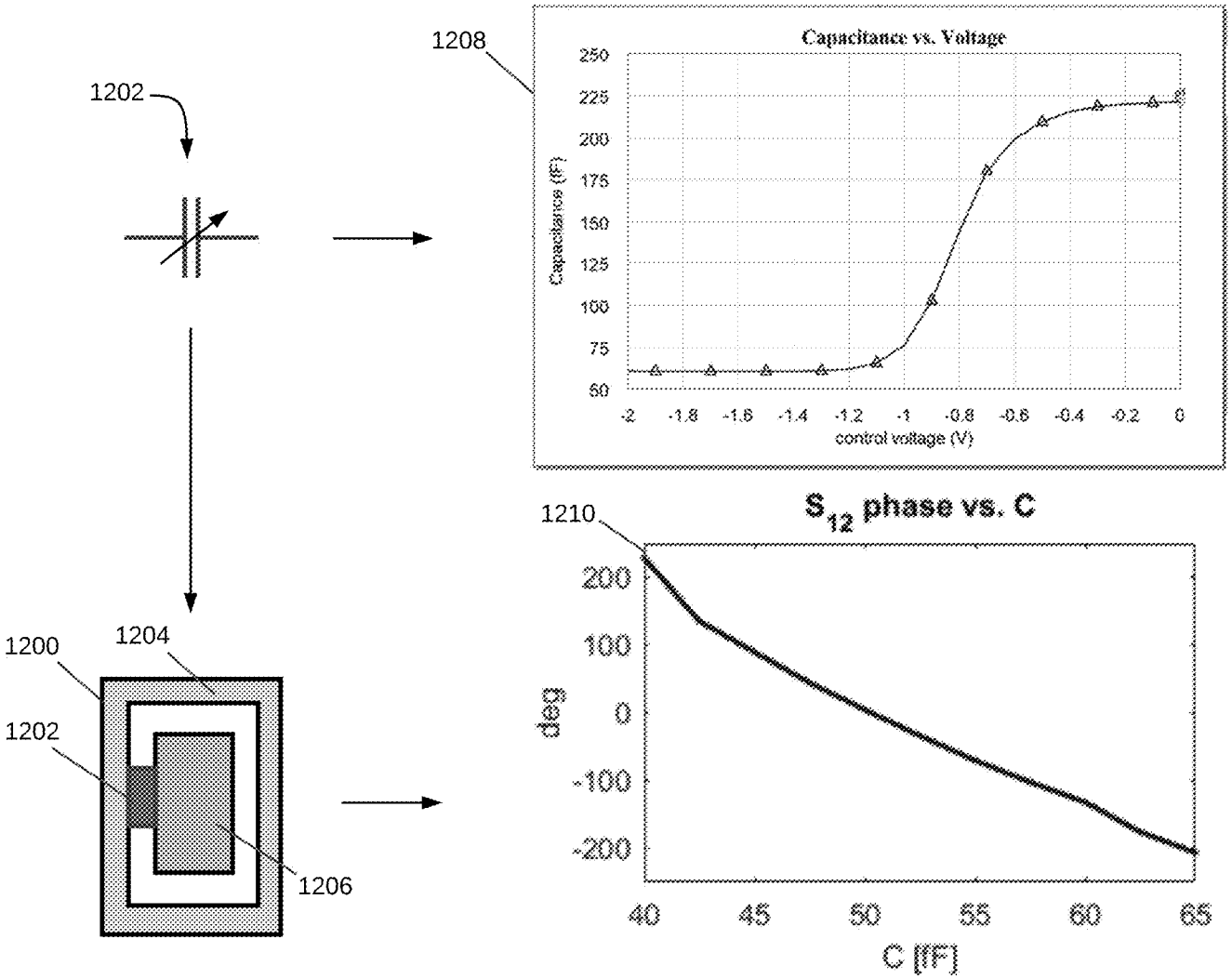
FIG. 12 illustrates an example radiating element with an integrated reactance control device.

FIG. 12 illustrates an example radiating element with an integrated varactor. Radiating element 1200 is illustrated having a conductive outer portion or loop 1204 surrounding a conductive area 1206 with a space in between. Radiating element 1200 may be configured on a dielectric layer, with the conductive areas and loops provided around and between different radiating elements. A voltage controlled variable reactance device 1202, e.g., a varactor, provides a controlled reactance between the conductive area 1206 and the conductive loop 1204. The controlled reactance is controlled by an applied voltage, such as an applied reverse bias voltage. The change in reactance changes the behavior of the radiating element 1200, enabling a radiating array structure to provide focused, high gain beams directed to a specific location.

Graph 1208 illustrates how the varactor 1202's capacitance changes with the applied voltage. The change in reactance of varactor 1202 changes the behavior of the radiating element 1200, enabling a radiating array structure 124 to provide focused, high gain beams directed to a specific location. Each beam may be directed to have a phase that varies with the reactance of the varactor 1202, as shown in graph 1210 illustrating the change in phase with the change in reactance of varactor 1202. With the application of a control voltage to the varactor 1202, the radiating element 1200 is able to generate beams at any direction about a plane.

Figure 13:
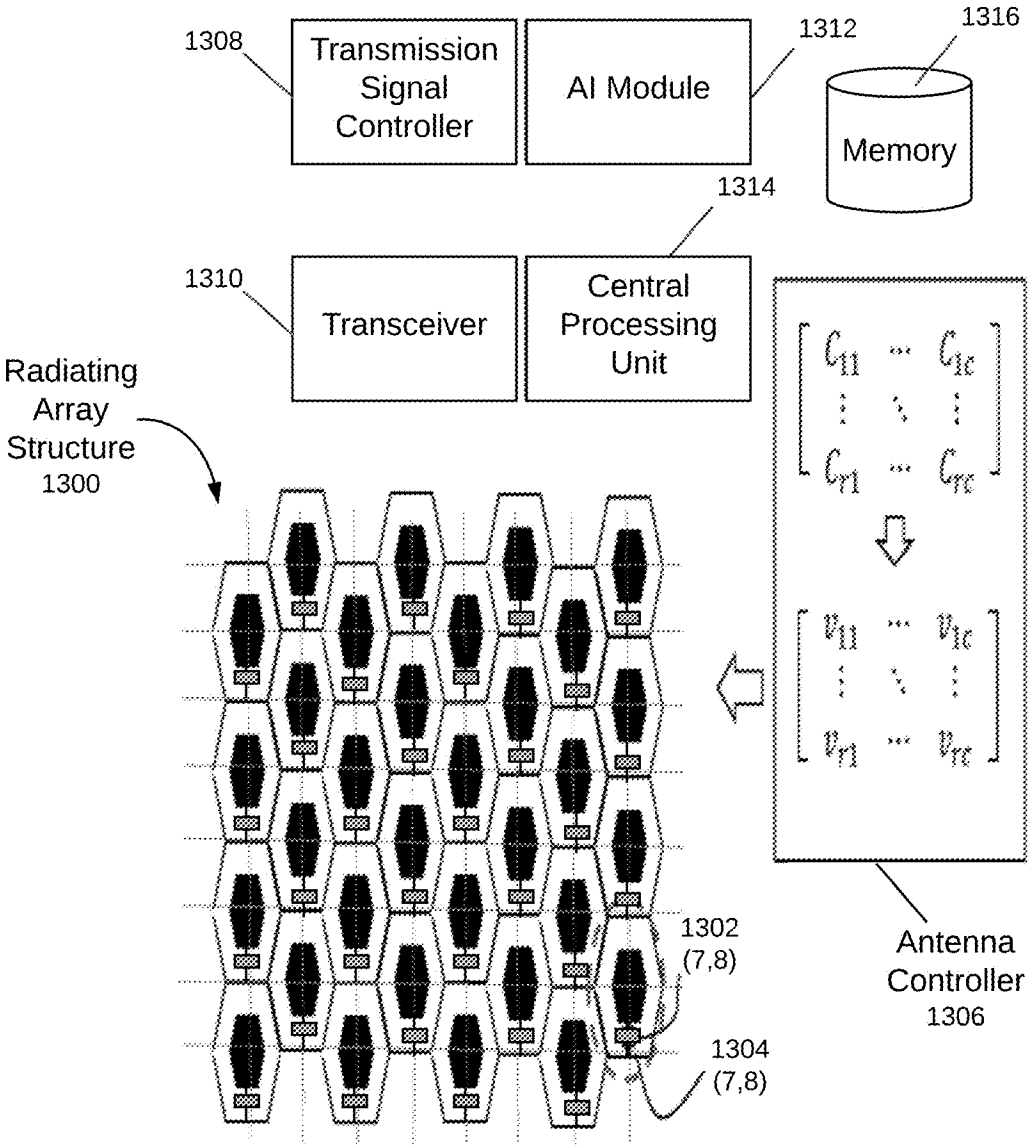
FIG. 13 is a schematic diagram of an example radiating array structure incorporating radiating elements with a reactance control device.

An example radiating array structure incorporating radiating elements with a reactance control device is shown in FIG. 13. Radiating structure 1300 has radiating elements with integrated reactance control devices, e.g., varactors. For example, in radiating element 1302 (7,8), which is the element in the $7^{th}$ row and the $8^{th}$ column, the reactance control device 1304 (7,8) is positioned as indicated, between the conductive patch and the conductive loop of radiating element 1302. In some examples, each radiating element in the radiating array structure 1302 has a reactance control device positioned between its patch and loop. In some examples, not all radiating elements have a reactance control device. In some other examples, the position of the reactance control device is positioned in different locations of a radiating element structure. The reactance control devices are positioned to facilitate phase changes in the transmitted radiation beam or beams from the radiating array structure 1300. Each reactance control device is controlled by an antenna controller 1306, which may be a bias circuit with a voltage control matrix with reverse bias voltages to control a varactor diode. Alternate examples may implement any of a variety of devices and configurations to achieve the electrical and/or electro-magnetic properties of the radiating element(s) in radiating array structure 1300.

Figure 14:
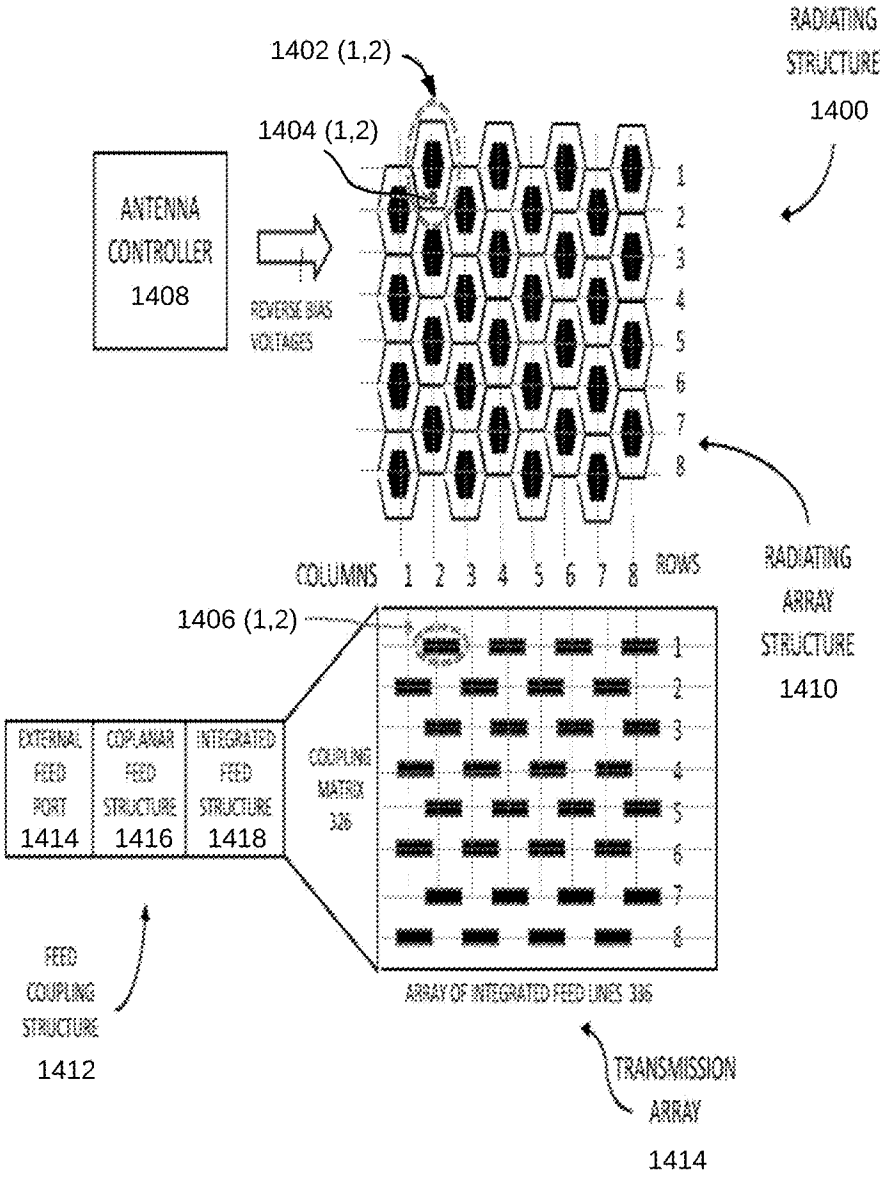
FIG. 14 illustrates a radiating structure having a transmission array proximate a radiating array structure in accordance with various examples.

FIG. 14 illustrates a radiating structure 1400 having a transmission array 1414 proximate a radiating array structure 1410, illustrated to correlate radiating elements 1402 to slots 1406. The radiating element 1402 (1,2) is illustrated in row 1, column 2, and has an outer loop and an inner patch of conductive material with a reactance control device 1404 coupled therebetween. Antenna controller 1408 controls the bias voltage applied to the reactance control device 1404, which changes the capacitance value of the reactance control device 1404 and results in a change in the effective capacitance of the radiating element 1402. Note that there may be any number of reactance control devices in the radiating elements of the radiating array structure 1410 so as to achieve the desired effective capacitance of radiating elements and result in a given beam formation and phase shift. The change in effective capacitance of the radiating elements acts to shift the phase of the signal transmitted from the radiating array structure 1410.

Figure 15:
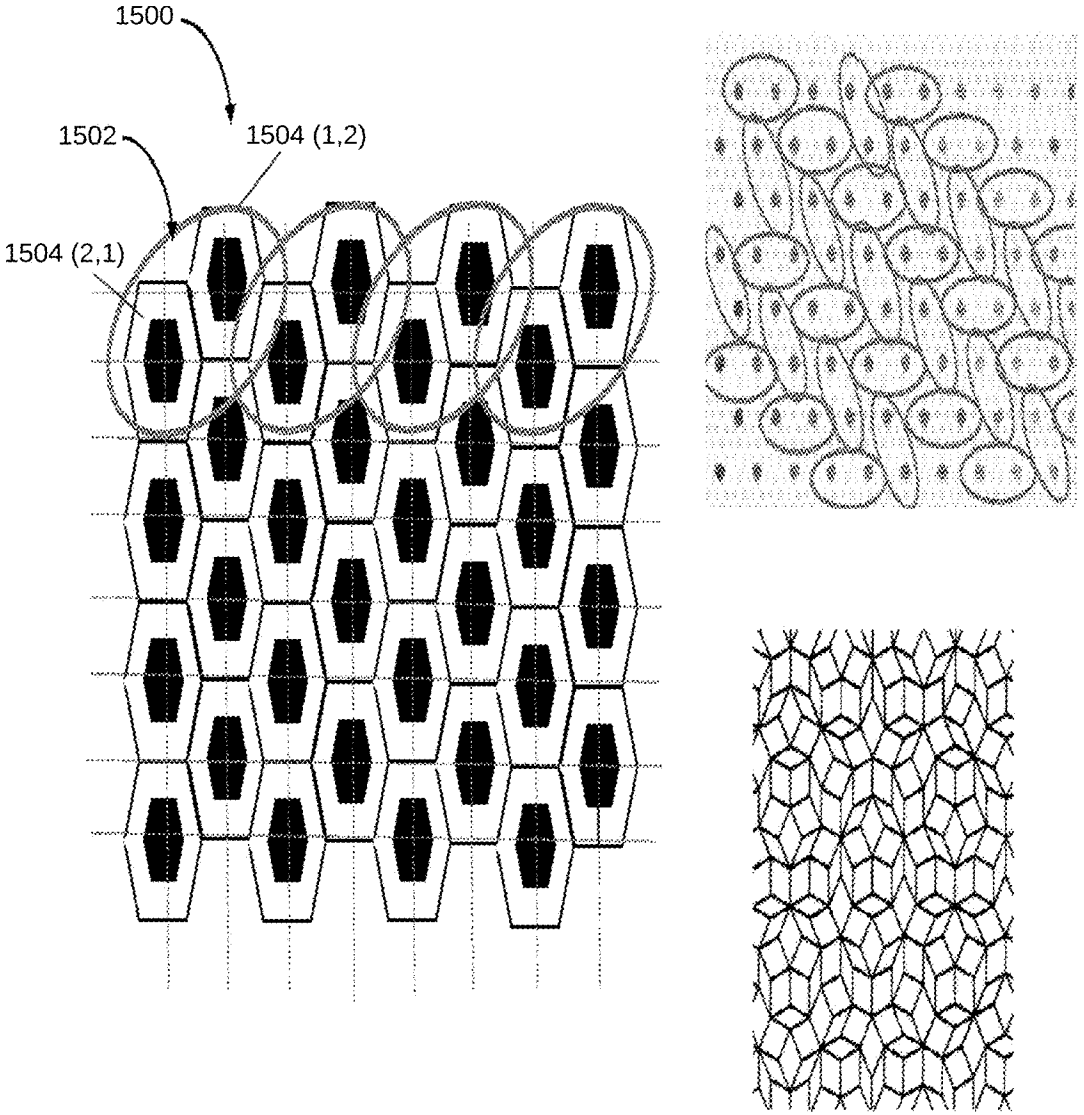
FIG. 15 illustrates a radiating structure configuration in which radiating elements are grouped together in subarrays in accordance with various examples.

As described above, radiating elements can be grouped together in a radiating array structure as subarrays and controlled as a single unit. FIG. 15 illustrates such a configuration. In radiating array structure portion 1500, groupings of radiating elements are indicated by the circled elements. As shown, group 1502 includes radiating elements 1504 (1,2) and 1504 (2,1). These two elements are operated as a group, and in some examples, these radiating elements may share a reactance control device (not shown). FIG. 15 also illustrates alternate groupings, wherein the groupings may have a periodic format, an aperiodic format, a random format and so forth.

Figure 16:
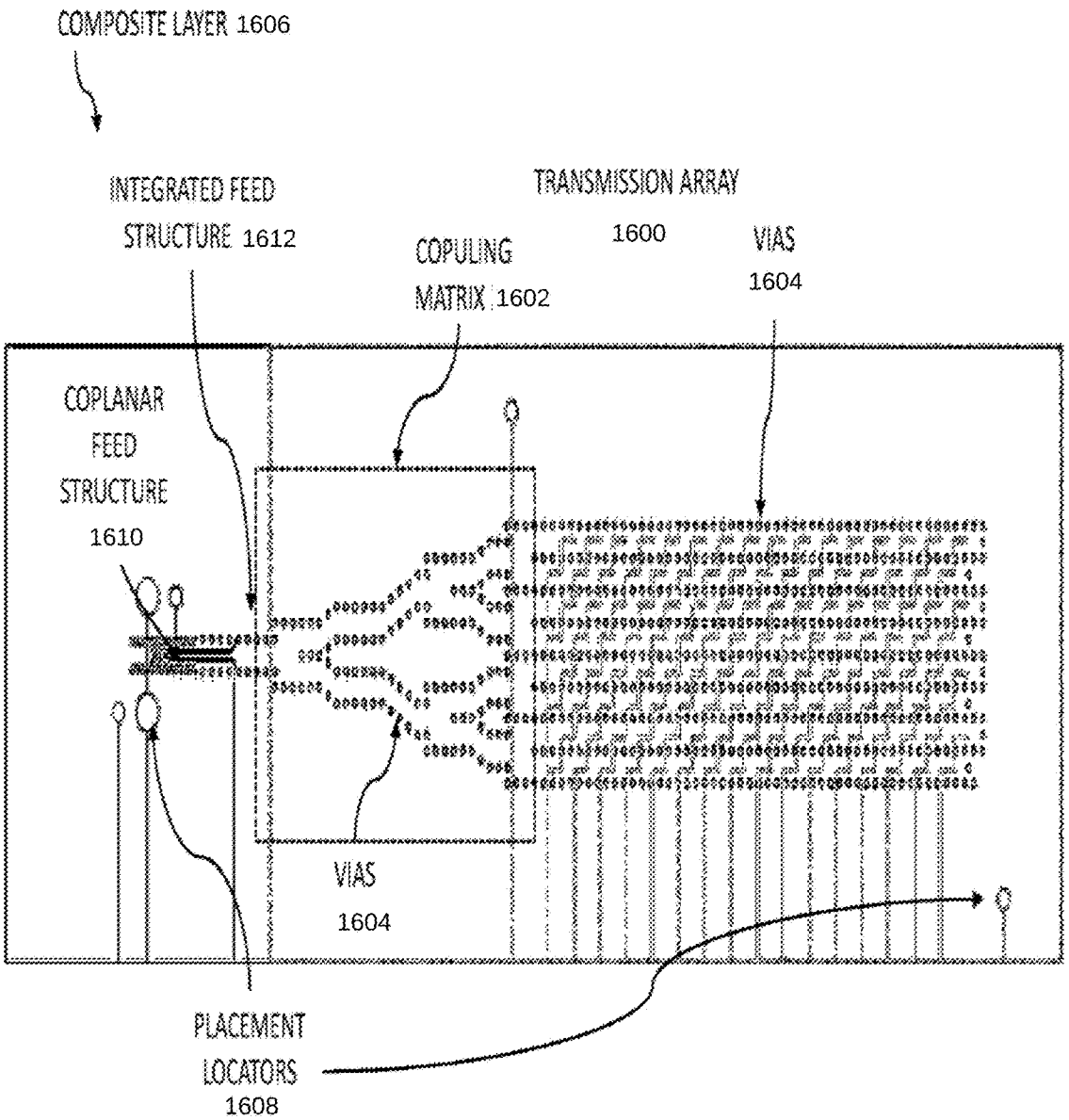
FIG. 16 illustrates a layout of a portion of a radiating structure on a composite layer in accordance with various examples.

Attention is now directed to FIG. 16, which illustrates paths for propagation of signals from input to the coplanar feed structure 1610 to transmission array structure 1600. Intervening structures and layers are provided as an example, but are not meant to limit the designs and configurations of the present invention. The transmission array structure 1100 may be formed in a variety of builds, which may use multiple layers, boards, and so forth. Vias are used to form waveguides in the examples herein, however, alternate methods may be implemented to maintain a waveguide-like structure to direct transmission signals. FIG. 16 illustrates a combination of the layout of a portion of a radiating structure on a composite layer, wherein the layout design is provided for clarity and understanding of the reader. As illustrated, the transmission paths of the transmission array structure 1600 are defined by the via paths bordering each row. The coupling matrix 1602 divides the transmission paths by the configuration of vias 1604 as illustrated. These vias 1604 are also holes through the substrate that are plated or lined with a conductive material, to connect two individual conductive portions of the composite layer 1606. This layout may be fabricated as a single component having multiple layers and with placement locators 1608, or holes, to position a radiating array structure correctly within the composite layer 1606. As discussed hereinabove, each of the slots in the transmission array structure 1400 is to be placed proximate a corresponding one of the radiating elements of the radiating array structure, and such proximity may be below or underneath from the illustrated perspective. Also illustrated are the coplanar feed structure 1610 and the integrated feed structure 1612 that provide the transmission signal to the transmission array structure 1600. The signal is radiated through the slots to the radiating elements in a radiating array structure positioned above the transmission array structure 1600. The radiating array structure (not shown) can be a single layer or multiple layers positioned above or below the transmission array structure as described above.

Figure 17:
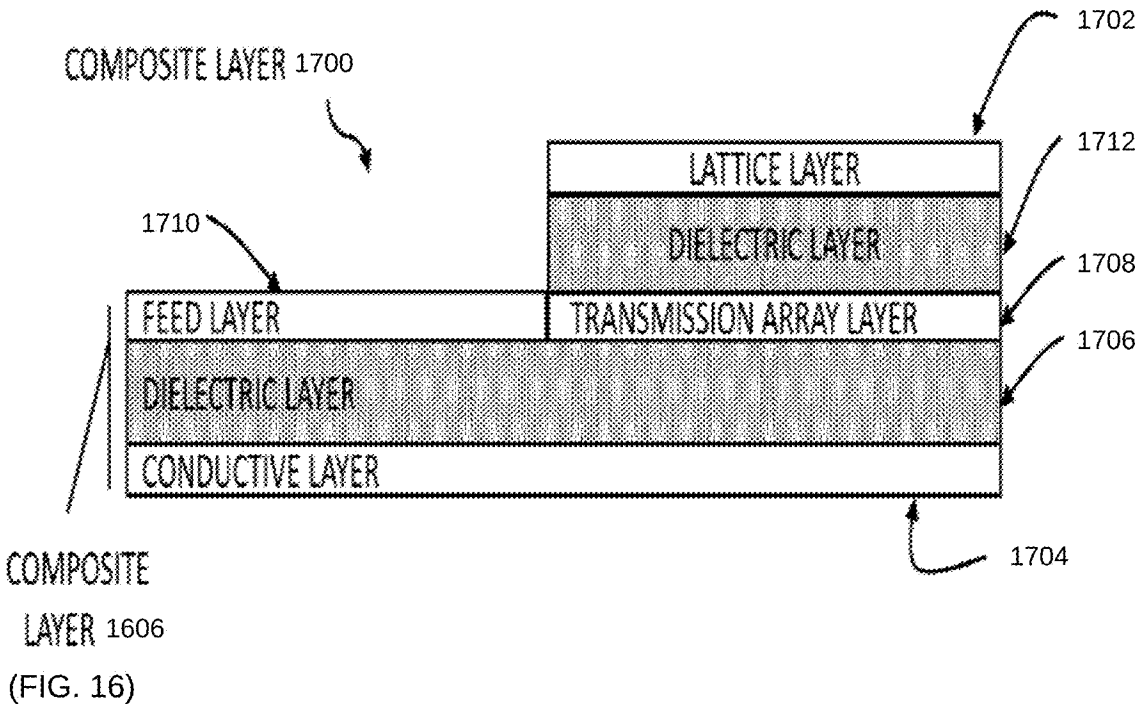
FIG. 17 illustrates a side view of a composite layer in accordance with various examples.

FIG. 17 illustrates a side view of a composite layer 1700, having the radiating array structure 1702 appended to the composite layer 1706. The conductive layer 1704 is coupled to a dielectric layer 1706. The components illustrated in FIG. 16 are formed in layer 1708 and are defined by a feed portion 1710 and the transmission array structure 1600 portion. The feed portion 1710 includes the external feed port 202, the coplanar feed structure 204, the integrated feed structure 206 and the coupling matrix 208. The transmission array structure 1600 is made up of conductive material formed on a dielectric layer 1712 sandwiched between layers 1708 and 1702. As described herein, the transmission array structure 1600 has a plurality of slots that correspond to a plurality of radiating elements in the radiating structure or lattice layer 1202.

Figure 18:
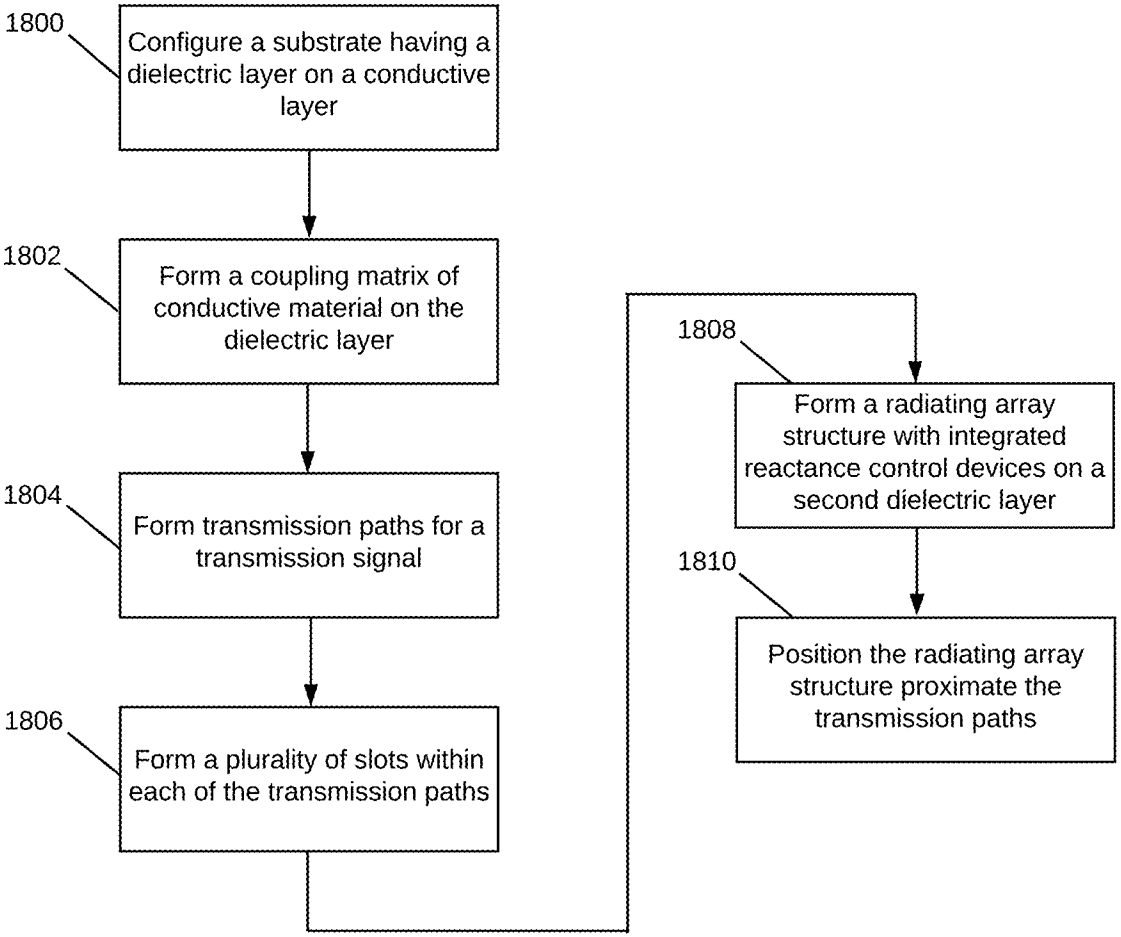
FIG. 18 is a flowchart for manufacturing a wireless transmission device having a radiating structure in accordance with various examples.

A flowchart for manufacturing a wireless transmission device with the radiating structure in FIG. 17 is shown in FIG. 18. First, a substrate is configured to have a dielectric layer on a conductive layer (1800). Next, a coupling matrix of conductive material is formed on the dielectric layer (1802). The coupling matrix is formed by placing vias through the dielectric layer to the conductive layer. The vias are lined with conductive material to form a conduit for a transmission signal to travel in the substrate. Once the coupling matrix is built, the transmission paths are formed (1804) and the slots are carved out within each of the transmission paths (1806). A radiating array structure with integrated reactance control devices is then formed on a second dielectric layer (1808) and positioned proximate the transmission paths (1810) to allow for a correspondence between each radiating element and a slot in a transmission path. As described above, the radiating array structure is a single or multi-layer array of radiating elements that can be designed as metamaterial elements with a desired shape and configuration to achieve a desired radiation pattern and performance.

Figure 19:
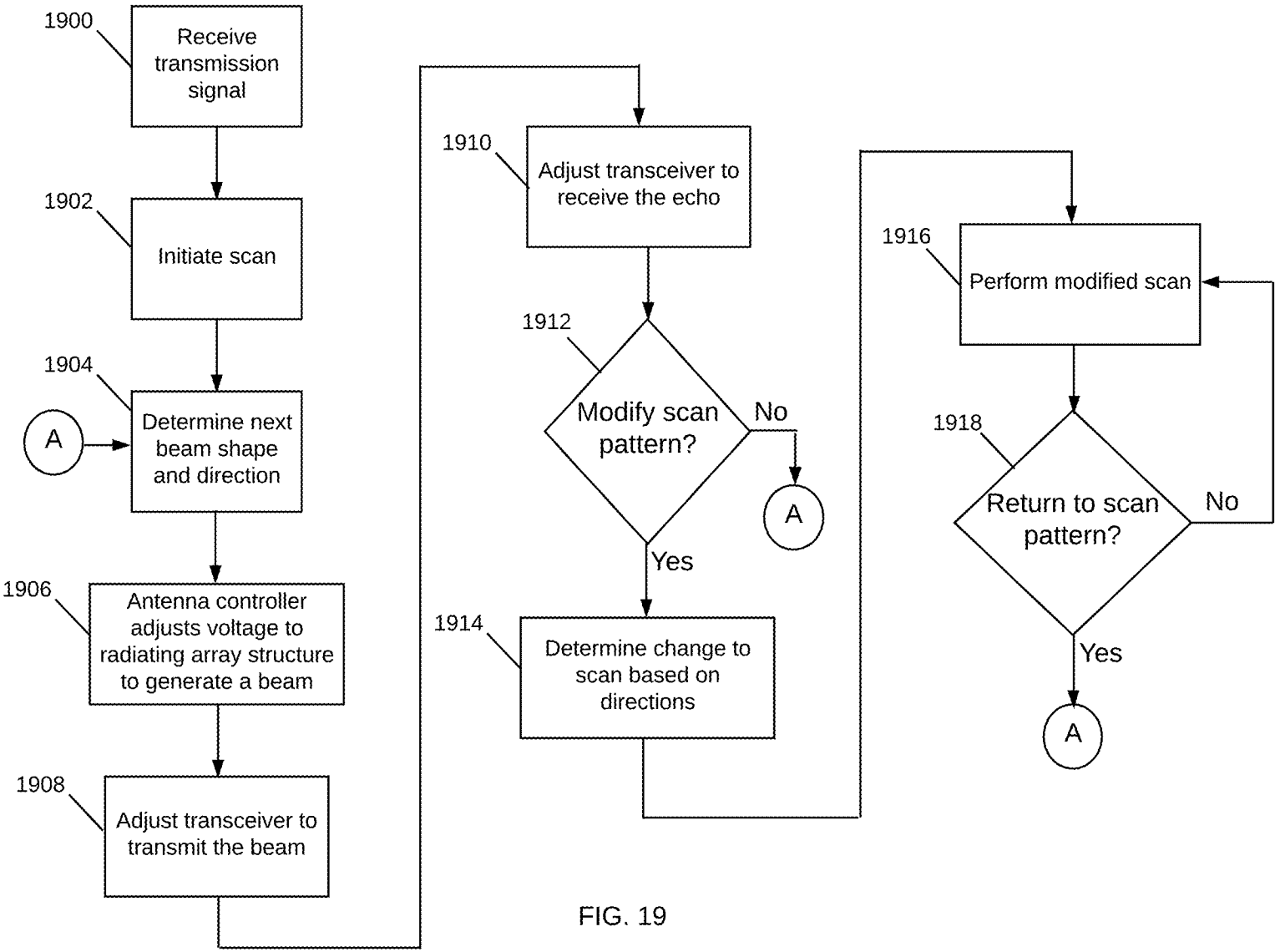
FIG. 19 is a flowchart for operating a radiating structure in accordance with various examples.

A flowchart for operating a radiating structure in accordance with various examples is illustrated in FIG. 19. In operation, the system 100 is adaptable for a radiating structure to receive a transmission signal (1900). The system 100 initiates a scan (1902) and determines a beam shape and direction (1904). The antenna controller adjusts voltages to the reactance control devices in the radiating structure to achieve the desired beam formation (1906). The transceiver transmits the beam (1908) and receives the echo (1910). If the received echo indicates a modification to the scan pattern (1912), such as when a target is detected and the system 100 wants more information about the target, then processing continues to initiate a modified scan. Else, processing continues to determine the next beam (1914). If the scan is modified, the system 100 performs the modified scan (1916) and monitors for completion of the modified scan (1918). Once the modified scan is no longer indicated, the system 100 returns processing to determine the next beam (1904).

Figure 20:
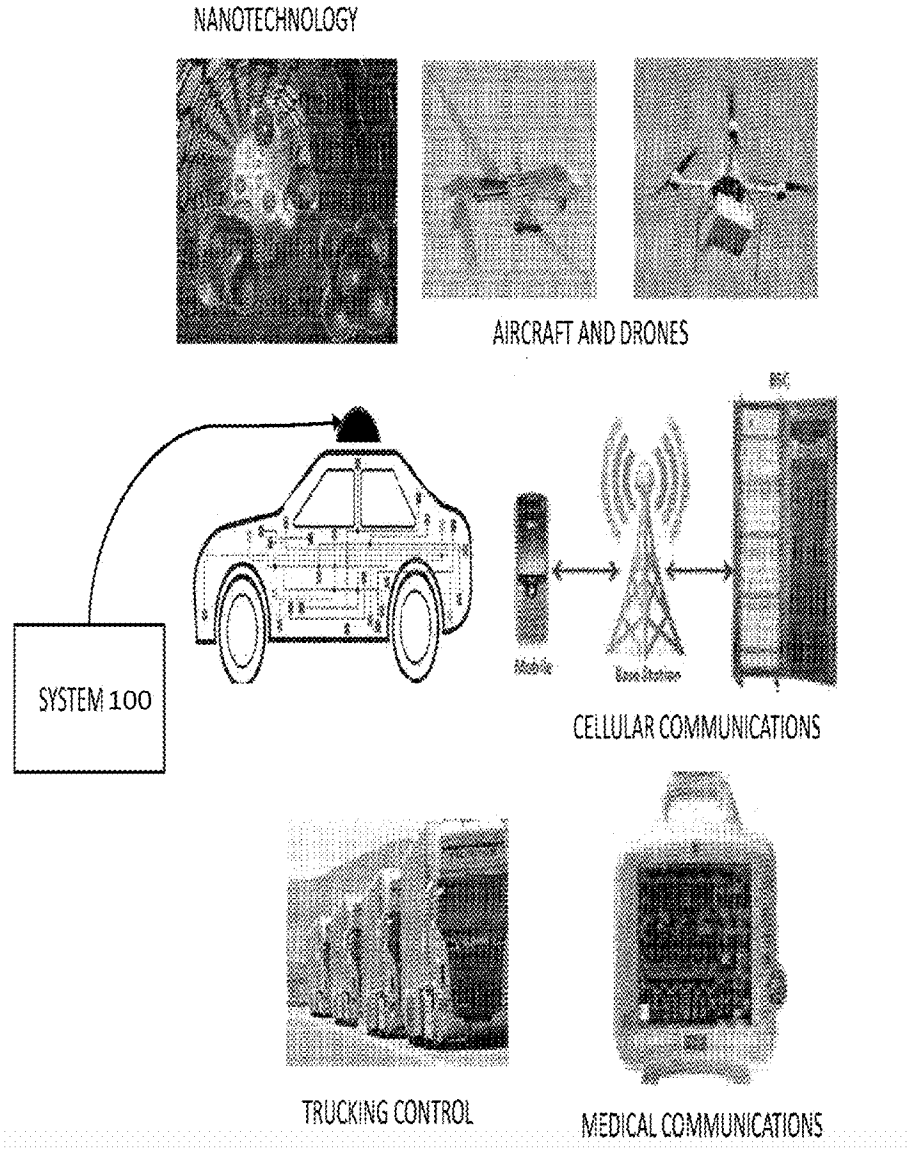
FIG. 20 illustrates applications of a system as in FIG. 1 in accordance with various examples.

The present inventions provide methods and apparatuses for radiating a signal. The methods and apparatuses are applicable in a variety of technical areas, including self-driving cars, truck platooning, drones, navigational devices, hospital monitoring devices, research and nanotechnology monitoring, cellular communication systems and more. Some of these applications are illustrated in FIG. 20. The radiating structure disclosed hereinabove with an array of radiating elements, a transmission array and a feed structure is capable of generating beams at desired phase shifts. The feed structure distributes the transmission signal throughout the transmission array, wherein the transmission signal propagates along the rows of the transmission array and slots are positioned along each row. The slots are positioned to correspond to radiating elements of a radiating array structure. The radiating elements have a desired shape that is conducive to dense configurations optimizing the use of space and reducing the size of a conventional antenna. In various examples, radiating elements include voltage-controlled reactance controlled devices for generating phase shifts according to the control voltage.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein.

What is claimed is:

1. A wireless radiating structure, comprising:

a composite layer formed of a dielectric layer on a conductive layer, the dielectric layer having a planar feed coupling structure adapted to receive and propagate a transmission signal to a co-planar transmission array structure having a plurality of slots;

a radiating array structure of a plurality of radiating elements, each radiating element corresponding to a slot in the transmission array structure and at least one radiating element is coupled to an integrated reactance control device; and a plurality of phase shift elements coupled to the plurality of radiating elements, and configured within the transmission array structure, wherein the plurality of radiating elements are arranged in a lattice configuration that enables a dense packing of the plurality of radiating elements, and wherein the plurality of radiating elements share the integrated reactance control device and are controlled as a single unit that enables a phase of the transmission signal to be shifted.

2. The wireless radiating structure of claim 1, wherein the radiating array structure is formed on a second dielectric layer positioned above and proximate the transmission array structure, wherein a first radiating element shape is different from a first transmission array element.

3. The wireless radiating structure of claim 1, wherein the wireless radiating structure further comprises:

a beam steering module coupled to the radiating structure, wherein the at least one radiating element is a metamaterial radiating element having a conductive outer loop and a conductive patch circumscribed within the conductive outer loop and wherein the reactance control device is a varactor placed between the conductive outer loop and the conductive patch.

4. The wireless radiating structure of claim 1, wherein the radiating array structure comprises a multi-layer radiating array structure, wherein each layer of the multi-layer radiating array structure comprises an array of radiating elements.

5. The wireless radiating structure of claim 1, wherein the wireless radiating structure is adapted to track a user device in a radar system.

6. The wireless radiating structure of claim 1, wherein the transmission signal comprises an FMCW sawtooth signal used in long range detection of a target.

7. The wireless radiating structure of claim 1, wherein the radiating elements are arranged in subarrays.

8. The wireless radiating structure of claim 7, wherein each subarray is adapted for transmitting a separate transmission beam.

9. The wireless radiating structure of claim 1, further comprising a beam steering means coupled to the radiating elements.

10. The wireless radiating structure of claim 9, wherein the beam steering means is a phase shifting means.

11. The wireless radiating structure of claim 10, wherein the radiating elements are arranged randomly.

12. A method for manufacturing a radiating structure, comprising: configuring a substrate having a first dielectric layer on a conductive layer;

forming a planar coupling matrix of conductive material on the first dielectric layer;

forming a coplanar feed structure coupled to the planar coupling matrix;

forming a plurality of coplanar transmission paths on the first dielectric layer for propagation of a transmission signal;

forming a plurality of slots within each of the transmission paths; and forming a radiating array structure on a second dielectric layer, the radiating array structure enabling the transmission signal to be radiated and having a plurality of radiating elements with at least one integrated reactance control device and corresponding to the plurality of slots, wherein the plurality of radiating elements are arranged in groupings to form subarrays and wherein each grouping in the groupings shares the at least one integrated reactance control device and is controllable as a single unit that enables a phase of a transmission signal to be shifted.

13. The method of claim 12, wherein the coupling matrix comprises a first set of vias through the first dielectric layer to the conductive layer that forms a plurality of impedance-matched transmission lines.

14. The method of claim 12, wherein the transmission paths comprise a second set of vias through the first dielectric layer to the conductive layer.

15. The method of claim 12, further comprising: determining a shape of the radiating elements.

16. A method of designing a radiating structure having a plurality of radiating elements, comprising:

determining a radiating element shape and a configuration of the plurality of radiating elements, wherein the plurality of radiating elements are configured in a lattice structure and at least a portion of the plurality of radiating elements are grouped as a single unit, share at least one reactive control device, and are configured to enable a phase of a transmission signal to be shifted;

determining a planar feed structure to distribute signals to the plurality of radiating elements, wherein the planar feed structure is adapted to receive and propagate a transmission signal to a co-planar transmission array structure having a plurality of slots;

determining a number of conductive layers and dielectric layers;

and configuring the co-planar transmission array structure to the radiating elements.

17. The method of claim 16, wherein determining the radiating element shape and configuration further comprises determining a set of phase shifts for the radiating structure.

18. The method of claim 17, wherein determining the radiating element shape and configuration further comprises determining a beam width for operation of the radiating structure.

19. The method of claim 18, wherein determining the radiating element shape and configuration further comprises determining an azimuth angle range and an elevation angle range.

20. The method of claim 16, wherein the radiating elements are arranged in groupings corresponding to subarrays.

* * * * *